US007287998B2

(12) United States Patent
Masai

(10) Patent No.: US 7,287,998 B2
(45) Date of Patent: Oct. 30, 2007

(54) CONNECTION DEVICE, IMAGE FORMING APPARATUS AND OPTIONAL DEVICE EQUIPPED WITH THE SAME

(75) Inventor: Katunori Masai, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 0 days.

(21) Appl. No.: 11/416,106

(22) Filed: May 3, 2006

(65) Prior Publication Data

US 2006/0248733 A1 Nov. 9, 2006

(30) Foreign Application Priority Data

May 9, 2005 (JP) ..... 2005-136024

(51) Int. Cl.
*H01R 4/50* (2006.01)

(52) U.S. Cl. ..... 439/346; 439/347; 439/342

(58) Field of Classification Search ..... 439/342, 439/347, 346, 312, 313, 337, 953
See application file for complete search history.

(56) References Cited

U.S. PATENT DOCUMENTS 2,186,601 A * 1/1940 Borkenstein ..... 439/117
2,290,816 A * 7/1942 Schauer ..... 439/342
2,449,221 A * 9/1948 Hammerly ..... 335/2
3,564,482 A * 2/1971 Yamanaka et al. ..... 439/343
4,040,698 A * 8/1977 Ortiz ..... 439/136
5,577,923 A * 11/1996 Lee ..... 439/170

FOREIGN PATENT DOCUMENTS

JP 11-193136 7/1999

* cited by examiner

*Primary Examiner*—Neil Abrams
(74) *Attorney, Agent, or Firm*—Smith, Gambrell & Russell, LLP

(57) ABSTRACT

A connection device includes a fixed locking member that is connected electrically to a conductive first frame of a post processor, and a conductive movable locking member that contacts an outer face of the fixed locking member and can slide. A conductive positioning pin that is connected electrically to a conductive second frame of a copying machine is inserted in a pin insertion hole and a large diameter portion in an unlock position of the movable locking member. When the movable locking member is further moved to slide to a lock position, the positioning pin is engaged and fixed to a small diameter portion, so that a conductive plate spring of the movable locking member contacts the positioning pin.

3 Claims, 8 Drawing Sheets

CONNECTION DEVICE, IMAGE FORMING APPARATUS AND OPTIONAL DEVICE EQUIPPED WITH THE SAME

This application is based on Japanese Patent Application No. 2005-136024 filed on May 9, 2005, the contents of which are hereby incorporated by reference.

BACKGROUND OF THE INVENTION

1. Field of the Invention

The present invention relates to a connection device for connecting an optional device to a main body and making an electrical conduction between them. The present invention also relates to an image forming apparatus and an optional device equipped with the connection device.

2. Description of Related Art

Conventionally, a mechanical connection as well as an electrical conduction is realized between an image forming apparatus and an optional device, i.e., a post processor (that performs post processes such as a sorting process, a stapling process and a punching process of delivered paper sheets) in the following way using a conventional connection device. Note that the electrical conduction is necessary for preventing a malfunction or the like of the image forming apparatus due to static electricity charged in the post processor or radiation noises from the post processor. Hereinafter, a copying machine is exemplified as the image forming apparatus for explanation. FIG. 6 is an elevation view showing schematically a post processor that is equipped with a conventional connection device and a copying machine. Furthermore, FIGS. 7A and 7B are longitudinal sections showing schematically the conventional connection device for connecting the post processor to the copying machine. More specifically, FIG. 7A is a longitudinal section showing the conventional connection device before the post processor is connected to the copying machine, and FIG. 7B is a longitudinal section showing the conventional connection device after the post processor is connected to the copying machine. Furthermore, FIGS. 8A and 8B are schematic views from a side of the conventional connection device for explaining a lock mechanism of a positioning pin. More specifically, FIG. 8A is a schematic view from a side of the conventional connection device for explaining an unlock position, and FIG. 8B is a schematic view from a side of the conventional connection device for explaining a lock position. Note that a position where a user operates the copying machine corresponds to a front side of the copying machine.

As shown in FIG. 6, a post processor 70 is equipped with connection devices 71 for fixing positioning pins 51 and making an electrical connection when the post processor 70 is attached to the copying machine 50. Two pairs (total four) of connection devices 71 are disposed on the front and the rear sides of a conductive frame 72 of the post processor 70 as shown in FIG. 6.

As shown in FIG. 6, a copying machine 50 is equipped with conductive positioning pins 51 for making a mechanical connection and an electrical connection to the frame 72 of the post processor 71. Two pairs (total four) of the positioning pins 51 are disposed on the front and the rear sides of a conductive frame 53 of a main body exposed at a paper delivery portion 52 as shown in FIG. 6. Note that each of the frames 53 and 72 is arranged to cover a predetermined area for preventing a malfunction or the like of the image forming apparatus due to static electricity charged in the post processor or radiation noises from the post processor. Hereinafter, the positioning pin 51 and the post processor 71 will be described.

As shown in FIGS. 7A and 7B, the positioning pin 51 is made up of a conductive member having a columnar shape, and an end of the positioning pin 51 is provided with a thread portion 51*d* for fixing to the frame 53 and making electrical connection with the same. In addition, the positioning pin 51 includes a flange portion 51*c*, a stopper portion 51*a* and an engaging portion 51*b*. The flange portion 51*c* is fastened to the frame 53 with the thread portion 51*d*. The stopper portion 51*a* has a diameter that is the largest and tapered toward the other end for contacting a plate spring 77 described below when the post processor 70 is attached. The engaging portion 51*b* is closer to the fixed side than the stopper portion 51*a* and has a reduced diameter smaller than the stopper portion 51*a*. The positioning pin 51 is screwed to the frame 53, so it has an electrical connection with the frame 53.

As shown in FIGS. 7A through 8B, the conventional connection device 71 includes a conductive fixed locking member 73 and a conductive movable locking member 74. The fixed locking member 73 is fixed to the conductive frame 72 of the post processor 70 with a screw 78, and it has a pin insertion hole 75 having an opening with a diameter larger than the outer diameter of the positioning pin 51 on the frame 53 side of the copying machine 50 and a conductive plate spring 77 that is attached to the inner face of the fixed locking member 73 at the vicinity of the pin insertion hole 75 so as to close the pin insertion hole 75. The movable locking member 74 abuts the outer face of the fixed locking member 73 and is slidable in a sliding direction that is perpendicular to the insertion direction of the positioning pin 51, and it has an elliptic hole 76 extending in the sliding direction for inserting the positioning pin 51.

As shown in FIGS. 8A and 8B, the elliptic hole 76 of the movable locking member 74 includes a large diameter portion 76*a* and a small diameter portion 76*b*. The large diameter portion 76*a* has an opening diameter larger than the outer diameter of the stopper portion 51*a* of the positioning pin 51 and overlaps the pin insertion hole 75 of the fixed locking member 73 in the unlock position of the movable locking member 74 (the position shown in FIG. 8A) for permitting insertion of the positioning pin 51. The small diameter portion 76*b* extends from the large diameter portion 76*a* in the sliding direction for retaining the stopper portion 51*a* of the positioning pin 51 in the lock position of the movable locking member 74 (the position shown in FIG. 8B) in the state where the positioning pin 51 is inserted. In addition, an opening diameter 76*c* of the small diameter portion 76*b* is smaller than maximum outer diameters of the large diameter portion 76*a* and the stopper portion 51*a* of the positioning pin 51, and it is larger than the engaging portion 51*b* of the positioning pin 51.

Next, attachment and detachment of the post processor 70 having the conventional connection device 71 with respect to the copying machine 50 will be described below. Before attaching the post processor 70 to the copying machine 50, the movable locking members 74 of each of the connection devices 71 is moved to slide to the unlock position outward from the post processor 70 in the sliding direction as shown in FIG. 8A. Then, the pin insertion hole 75 of the fixed locking member 73 and the large diameter portion 76*a* of the movable locking member 74 are overlapped with each other so as to become in the state where the positioning pin 51 can be inserted.

Then, as shown in FIGS. 6 and 7A, the post processor 70 is moved by the user toward the copying machine 50 (in the direction of an arrow A). Then, the positioning pin 51 is inserted in the pin insertion hole 75 and the large diameter portion 76*a*. Further, the engaging portion 51*b* of each of the positioning pins 51 is inserted until it reaches the position of the large diameter portion 76*a* of each of the movable locking members 74.

Next, each of the movable locking members 74 is moved to slide from the unlock position shown in FIG. 8A toward the inside of the post processor 70 (in the direction of an arrow B) to the lock position shown in FIG. 8B. Then, as shown in FIG. 7B and FIG. 8B, the small diameter portion 76*b* of the movable locking member 74 moves to the engaging portion 51*b* of the positioning pin 51. Since the opening diameter 76*c* of the small diameter portion 76*b* of the movable locking member 74 is smaller than the outer diameter of the stopper portion 51*a* of the positioning pin 51, the stopper portion 51*a* is retained in the small diameter portion 76*b*. As a result, the engaging portion 51*b* of the positioning pin 51 is engaged with the small diameter portion 76*b* of the movable locking member 74 so that the positioning pin 51 is fixed by the engagement. On this occasion, the plate spring 77 contacts the stopper portion 51*a* of the positioning pin 51 so that an electric conduction is formed between them as shown in FIG. 7B. Therefore, the frame 72 of the post processor 70 is connected electrically to the frame 53 of the copying machine 50 via the fixed locking member 73, the movable locking member 74, the plate spring 77 and the positioning pin 11.

Furthermore, JP-A-11-193136 discloses an image forming apparatus that includes a connection device having a structure in which a conductive positioning pin of a paper feed device is engaged with a positioning hole of a main body. When the paper feed device is connected to the main body, a conductive elastic member provided to the main body abuts the positioning pin so that electric connection can be formed between the ground of the main body and the ground of the paper feed device. In addition, a sheet processor (corresponding to a sheet loading device) is connected to a conductive rail that is connected to the paper feed device, so that the sheet processor can be connected to the ground.

It is certainly possible for the conventional connection device 71 described above to fix the positioning pin 51 by the engagement between the engaging portion 51*b* of the positioning pin 51 and the small diameter portion 76*b* of the movable locking member 74 in the lock position of the movable locking member 74 when the post processor 70 is attached to the copying machine 50, and to make a electric conduction between the frame 72 of the post processor 70 and the frame 53 of the copying machine 50 when the plate spring 77 that is connected electrically to the frame 72 of the post processor 70 contacts the positioning pin 51.

In addition, it is possible for the image forming apparatus including the connection device disclosed in JP-A-11-193136 to connect the sheet processor to the ground of the image forming apparatus by making the electrical contact between the sheet processor and the conductive rail that is connected to the paper feed device.

However, the conventional connection device 71 has a problem as follows. Although the connection device 71 is required to make an electric conduction between the frame 72 of the post processor 70 and the frame 53 of the copying machine 50, to prevent the post processor 70 from being detached from the copying machine 50 due to a vibration or the like, and to be capable of detaching the post processor 70 from the copying machine 50 easily when a malfunction such as a paper jam, it is difficult to insert the positioning pin 51 or fix the positioning pin 51 by the engagement since a force of the plate spring 77 works in the direction of removing the positioning pin 51 from the connection device 71.

In addition, the image forming apparatus including the connection device disclosed in JP-A-11-193136 has a disadvantage of much effort necessary for detaching the sheet processor from the rail when a malfunction occurs in the sheet processor since the sheet processor (corresponding to the sheet loading device) is connected to the conductive rail that is connected to the paper feed device.

SUMMARY OF THE INVENTION

An object of the present invention is to provide a connection device that facilitates attachment and detachment between a main body of an image forming apparatus and an optional device. The connection device is also required to make an electric connection between them when the optional device is attached to the image forming apparatus. Another object of the present invention is to provide an image forming apparatus and an optional device that are equipped with the connection device.

A connection device according to the present invention includes a fixed locking member and a movable locking member. The fixed locking member is a conductive member connected electrically to a conductive first frame of a first device. An end of the fixed locking member is connected electrically to a conductive second frame of a second device. The other end of the fixed locking member is provided with a pin insertion hole for inserting a conductive columnar pin having an engaging portion. The movable locking member is a conductive member contacting an outer face of the fixed locking member and can slide in a sliding direction that is perpendicular to an insertion direction of the pin. The movable locking member has a first elliptic hole including a large diameter portion at an end for inserting the pin and a small diameter portion extending in the sliding direction for retaining an engaging portion of the pin. The movable locking member includes a conductive member having an end that is connected electrically to a face that is opposed to the fixed locking member. The fixed locking member includes a second elliptic hole extending in the sliding direction for the conductive member to be inserted and move together with the movable locking member. When the movable locking member is moved to slide to an unlock position, the pin insertion hole and the large diameter portion of the first elliptic hole are overlapped with each other so as to permit insertion of the pin. When the movable locking member is moved to slide from the unlock position to a lock position while the pin is inserted, the pin engages the small diameter portion of the first elliptic hole to engage and fix the pin so that the first device and the second device are connected and the conductive member contacts the pin.

According to this structure, it is easy to attach and detach the device having the connection device of the present invention to and from another device, and an electrical conduction between the devices can be formed easily. In addition, the devices can be fixed to each other when the device having the connection device of the present invention is attached to the other device. In addition, since the conductive member is not exposed to the outside of the device, it is safe for the user.

An image forming apparatus according to the present invention includes the connection device described above.

According to this structure, it is easy to attach and detach the optional device to and from the image forming apparatus. In addition, it is easy to form an electrical conduction between the image forming apparatus and the optional device.

The optional device according to the present invention has a structure with the connection device described above. According to this structure, it is easy to attach and detach the optional device to and from a device to which the optional device is connected. In addition, it is easy to form an electrical conduction between the optional device and a device to which the optional device is connected.

As described above, according to the connection device of the present invention and the image forming apparatus having the connection device as well as the optional device having the connection device, it is easy to attach and detach one of the devices with the connection device to and from the other device. In addition, it is easy to form an electrical conduction between the devices.

DESCRIPTION OF THE PREFERRED EMBODIMENTS

Figure 1:
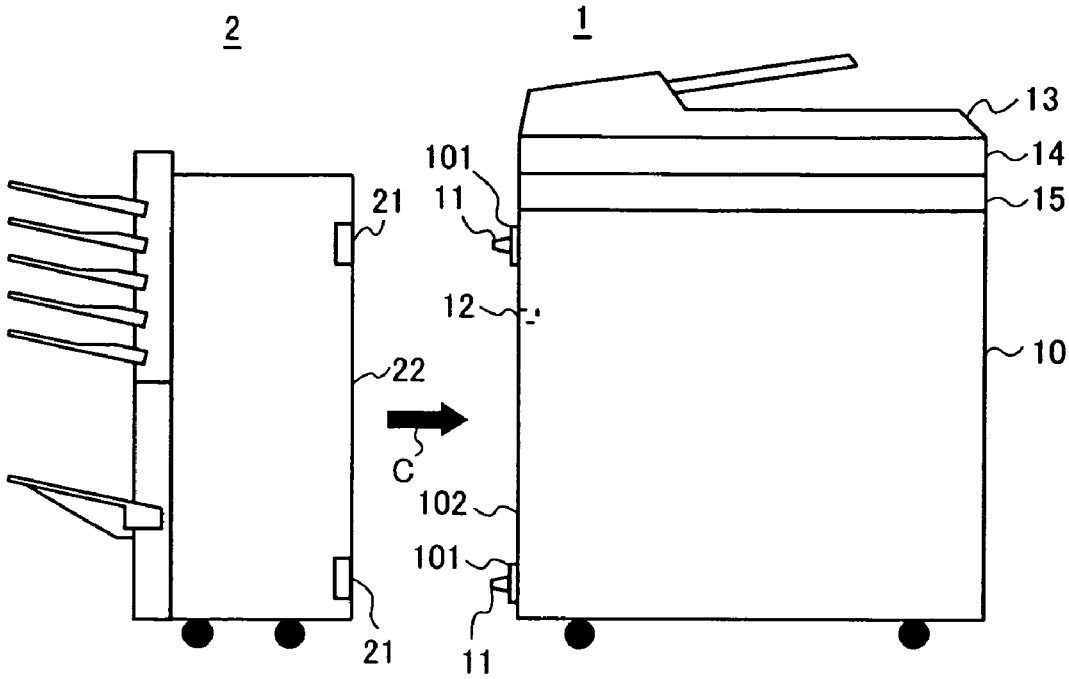
FIG. 1 is an elevation view showing schematically a post processor and a copying machine that are equipped with a connection device according to the present invention.
Figure 2:
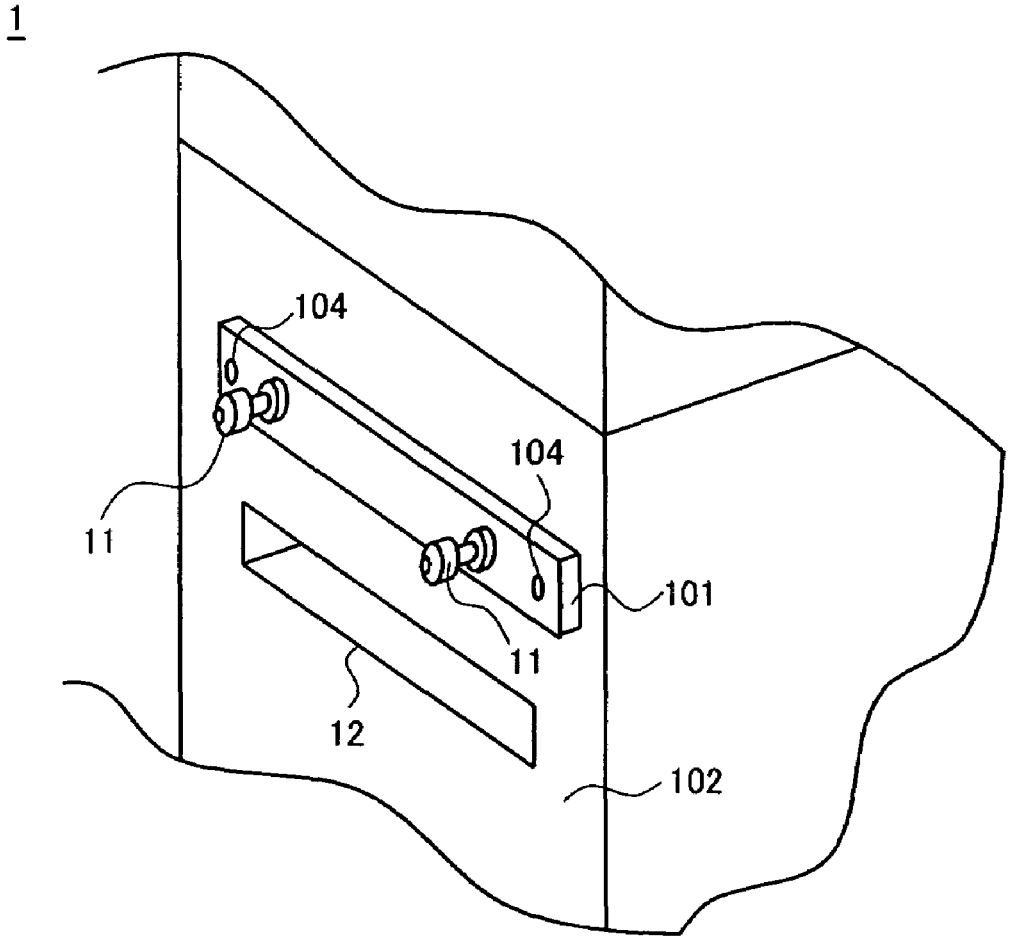
FIG. 2 is a perspective view showing schematically positioning pins arranged at a vicinity of a paper delivery portion of the copying machine.
Figure 3A:
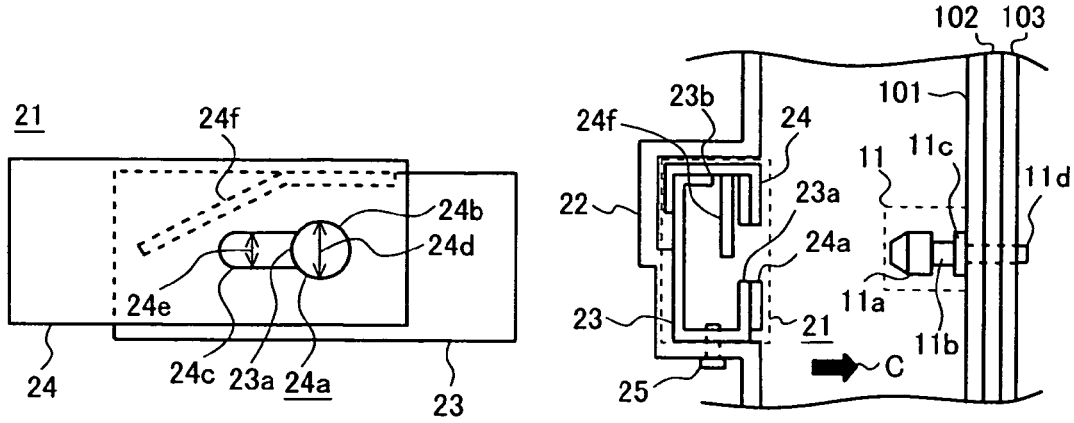
FIG. 3A shows the connection device before the post processor is attached to the copying machine.
Figure 3B:
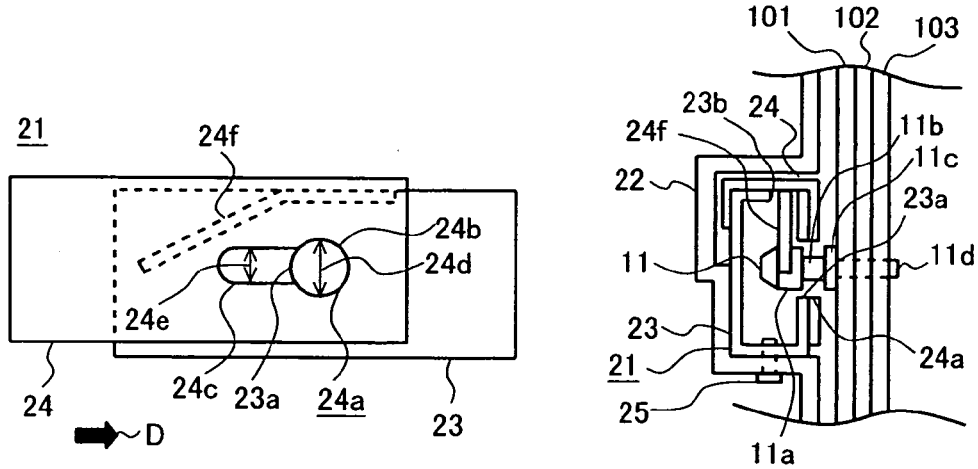
FIG. 3B shows connection between the copying machine and the post processor when a movable locking member of the connection device is in an unlock position.
Figure 3C:
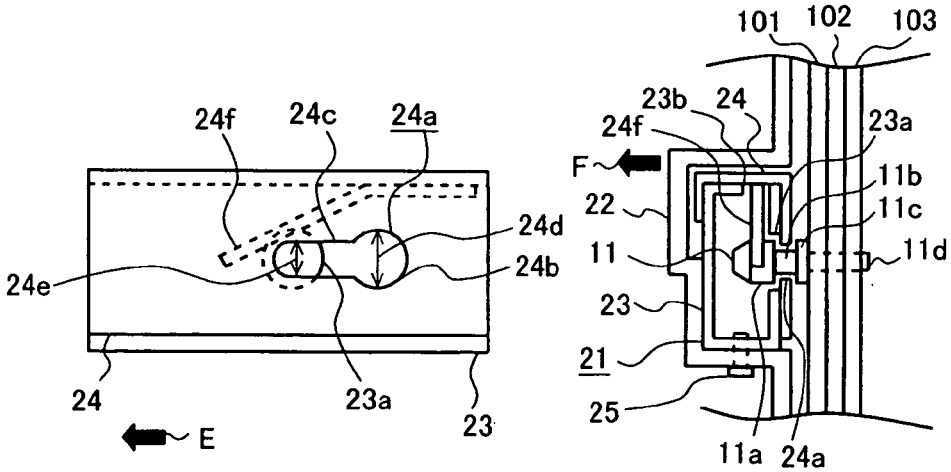
FIG. 3C shows connection between the copying machine and the post processor when a movable locking member of the connection device is in a lock position.

Hereinafter, an example of the present invention will be described. In the example, a connection device according to the present invention is applied to a post processor (corresponding to a first device) that is an optional device of a copying machine (corresponding to a second device). FIG. 1 is an elevation view showing schematically a post processor and a copying machine that are equipped with a connection device according to the present invention. FIG. 2 is a perspective view showing schematically positioning pins arranged at a vicinity of a paper delivery portion 12 of the copying machine 1. FIGS. 3A-3C are diagrams for explaining a structure of the main portion of the connection device that is provided to the post processor and its connection with the copying machine. FIG. 3A shows the connection device before the post processor is attached to the copying machine. FIG. 3B shows connection between the copying machine and the post processor when a movable locking member of the connection device is in an unlock position. FIG. 3C shows connection between the copying machine and the post processor when a movable locking member of the connection device is in a lock position. Note that an operating position where the user normally performs a copy operation is regarded as the front face (i.e., the front face side in FIG. 1). In addition, the diagrams on the right side in FIGS. 3A-3C are enlarged views of the connection device of the post processor and the positioning pin of the copying machine observed from the front, while the diagrams on the left side in FIGS. 3A-3C are side elevation view of the connection device of the connection device observed from the copying machine side in FIG. 1.

As shown in FIG. 1, the copying machine 1 includes a conductive positioning pin 11, a document feeding portion 13, an image reading portion 14, an operation display portion 15 and a paper delivery portion 12. The conductive positioning pin 11 is used for engaging and fixing (forming a mechanical connection) with a connection device 21 that is provided to a first frame 22 of a post processor 2 and for making an electrical conduction with the same. The document feeding portion 13 is used for feeding a document automatically. The image reading portion 14 reads the document fed by the document feeding portion 13 and generates image data. The operation display portion 15 includes an operating portion (such as a ten key or a touch panel) and a display portion (such as a liquid crystal display). The paper delivery portion 12 delivers printed paper sheets. Although not shown in FIG. 1, the copying machine 1 according to this embodiment naturally includes a central processing unit for controlling operations of the entire of the copying machine 1, an image forming portion and a fixing portion necessary for forming images, a paper sheet tray and a paper sheet feeding portion adding to the elements described above.

As shown in FIGS. 1 through 3C, the main body 10 of the copying machine 1 includes a second frame 103, a non-conductive cover 102 and a conductive third frame 101. The second frame 103 is a conductive frame of the main body 10 arranged in a predetermined area of the main body 10. The non-conductive cover 102 is provided to the paper delivery portion 12 side of the second frame 103. The conductive third frame 101 is fixed to the second frame 103 sandwiching the cover 102 with the positioning pin 11 described below and conductive screws 104. Note that the second frame 103 is arranged to cover a predetermined area of the main body 10 so as to reduce radiation noises, static electricity or the like. In addition, it is not necessary that the second frame 103 is connected to the ground.

The positioning pin 11 is made up of a columnar conductive member (made of a metal such as a stainless steel or aluminium, or a conductive resin, for example) as shown in FIGS. 1 and 2). Two pairs (total four) of the positioning pins 11 are disposed on the front and the rear sides in FIG. 1.

In addition, as shown in FIGS. 3A-3C, the positioning pin 11 has a thread portion 11*d* at an end for fixing to the second frame 103 and make an electrical connection with the same. Furthermore, the positioning pin 11 includes a flange portion 11*c* (with the thread portion 11*d*), a stopper portion 11*a* and an engaging portion 11*b*. The flange portion 11*c* is fastened to the second frame 103 with the thread portion 11*d* sandwiching the third frame 101 and the cover 102. The stopper portion 11*a* has an outer diameter tapered toward the non-screwed other end like a trapezoidal shape and contacts a plate spring 24*f* in a lock position of the movable locking member 24 as described below. The engaging portion 11*b* is closer to the fixed side than the stopper portion 11*a* and has a reduced outer diameter smaller than the stopper portion 11*a*. In addition, the stopper portion 11*a* has an area having an outer diameter larger than the engaging portion 11*b*. Note that it is possible that the positioning pin 11 includes only the stopper portion 11*a* and the engaging portion 11*b*. In this case, it is preferable that the bottom face of the engaging portion 11*b* is screwed to the second frame 103.

In this way, the positioning pin 11 is screwed to the second frame 103, so that an electrical connection is formed between the positioning pin 11 and the second frame 103.

As shown in FIG. 1, the post processor 2 equipped with the connection device 21 according to the present invention can perform post processes such as a sorting process, a stapling process and a punching process of printed paper sheets delivered from the paper delivery portion 12 of the copying machine 1.

In addition, as shown in FIG. 1, the post processor 2 includes a conductive first flame 22 arranged on the conductive second frame 103 side of the copying machine 1 (i.e., the reception side for receiving paper sheets delivered from the paper delivery portion 12).

The first frame 22 is provided with connection devices 21 that the positioning pin 11 of the copying machine 1 engages and is fixed to (for making a mechanical connection with) and makes an electrical conduction with when the post processor 2 is moved in the direction of an arrow C so as to be attached to the copying machine 1. Two pairs (total four) of the connection devices 21 are disposed on the front (the front side in FIG. 1) and the rear (the front side in FIG. 1) sides of the copying machine 1.

Furthermore, the first frame 22 is arranged to cover a predetermined area so as to prevent a malfunction or the like of the copying machine 1 due to static electricity charged in the post processor 2 or radiation noises from the post processor 2.

As shown in FIGS. 1 and 3A-3C, the connection device 21 includes a conductive fixed locking member 23 and a conductive movable locking member 24. The conductive fixed locking member 23 is fastened to the first frame 22 with one or more conductive screws 25, and it has a pin insertion hole 23*a* for inserting the positioning pin 11. The conductive movable locking member 24 contacts the upper face and both side faces of the fixed locking member 23 and permits the positioning pin 11 to slide in a sliding direction that is perpendicular to its insertion direction. Note that the fixed locking member 23 and the movable locking member 24 are made of a metal such as a stainless steel or aluminium or the like.

In this way, the fixed locking member 23 is fastened to the first frame 22 with the conductive screws 25, so it is connected to the first frame 22 electrically. In addition, since the conductive movable locking member 24 contacts the outer face of the conductive fixed locking member 23, it has an electrical conduction with the fixed locking member 23.

In addition, as shown in FIGS. 3A-3C, the upper face of the fixed locking member 23 is provided with a second elliptic hole 23*b* that is formed in the sliding direction for the plate spring 24*f* to enter and move together with the movable locking member 24.

In addition, as shown in FIGS. 3A-3C, the pin insertion hole 23*a* has a diameter that is equal to or larger than the maximum outer diameter of the stopper portion 11*a* on the positioning pin 11 side (i.e., the reception side for receiving paper sheets delivered from the paper delivery portion 12), so that the stopper portion 11*a* of the positioning pin 11 can be inserted.

In addition, as shown in FIGS. 3A-3C, the movable locking member 24 includes a first elliptic hole 24*a* and a conductive plate spring 24*f*. The first elliptic hole 24*a* is formed in the face of the positioning pin 11 side for engaging and fixing the inserted positioning pin 11. An end of the plate spring 24*f* is fixed to a face of the movable locking member 24 that is opposed to the upper face of the fixed locking member 23 so that an electric connection is formed. The other end of the plate spring 24*f* is inserted in the second elliptic hole 23*b* of the fixed locking member 23. Note that it is required that the plate spring 24*f* is a conductive member regardless that it has elastic property or not.

In addition, as shown in FIGS. 3A-3C, the first elliptic hole 24*a* of the movable locking member 24 includes a large diameter portion 24*b* for inserting the positioning pin 11 at an end and a small diameter portion 24*c* extending from the large diameter portion 24*b* in the sliding direction of the movable locking member 24 for engaging the stopper portion 11*a* of the positioning pin 11. In addition, the opening diameter 24*d* of the large diameter portion 24*b* has a diameter that is equal to or larger than the maximum outer diameter of the stopper portion 11*a* of the positioning pin 11 so that the positioning pin 11 can be inserted. In addition, an opening diameter 24*e* of the small diameter portion 24*c* that extends from the large diameter portion 24*b* is smaller than the maximum outer diameter of the stopper portion 11*a* of the positioning pin 11.

Next, attachment and detachment of the post processor 2 having the connection device 21 according to this embodiment with respect to the copying machine 1 as well as an electric connection between the first and the second frames will be described with reference to FIGS. 1 through 3C.

As shown in FIG. 3A, before attaching the post processor 2 to the copying machine 1, a user moves each movable locking member 24 to slide in the sliding direction (that is perpendicular to the insertion direction of the positioning pin 11) toward the outside of the post processor 2 until the unlock position of the connection device 21 (the position shown in FIG. 3A) so as to be drawn out. Then, the pin insertion hole 23*a* of each of the fixed locking members 23 overlaps the large diameter portion 24*b* of each of the movable locking members 24, so that each of the positioning pins 11 can be inserted. Note that the two movable locking members 24 disposed on the front side of the post processor 2 are drawn out with sliding to the front side of the post processor 2 while the two movable locking members 24 disposed on the rear side of the post processor 2 are drawn out with sliding to the rear side of the post processor 2. In addition, since the plate spring 24*f* is fixed to the movable locking member 24, it moves along with the movable locking member 24 to a position away from the first elliptic hole 24*a*. Note that the state of the movable locking member 24 being in the unlock position is referred to as an unlock state.

Next, as shown in FIGS. 1 and 3A, when the post processor 2 is attached to the copying machine 1, each of the movable locking members 24 is located in the unlock position, and the user moves the post processor 2 toward the copying machine 1 (in the direction indicated by the arrow C). Then, as shown in FIG. 3B, each of the positioning pins 11 is inserted in the pin insertion hole 23*a* and the large diameter portion 24*b*. Further, it is inserted until the engaging portion 11*b* of each of the positioning pins 11 reaches the position of the large diameter portion 24*b* of each of the movable locking member 24.

On this occasion, as shown in FIG. 3B, the engaging portion 11*b* of each of the positioning pins 11 has reached the position of the large diameter portion 24*b* of each of the movable locking members 24, but each of the plate springs 24*f* is not contacted with each of the positioning pins 11. Therefore, the post processor 2 can be attached to the copying machine 1 easily.

Next, locking (engaging and fixing) of each of the positioning pins 11 with the connection device 21 is performed as follows. While the positioning pin 11 is inserted in the pin insertion hole 23*a* and the large diameter portion 24*b*, the user moves each of the movable locking members 24 to slide from the unlock position shown in FIG. 3B to the lock position shown in FIG. 3C (in the direction indicated by an arrow D in FIG. 3B). Then, each of the movable locking members 24 returns to the original position that matches each of the fixed locking members 23 as shown in FIG. 3C. On this occasion, the small diameter portion 24*c* of each of the movable locking members 24 moves to the engaging portion 11*b* of each of the positioning pins 11. Since the opening diameter 24*e* of the small diameter portion 24*c* of the movable locking member 24 is smaller than the outer diameter of the stopper portion 11*a* of the positioning pin 11, the stopper portion 11*a* is retained by the small diameter portion 24*c*. Thus, the engaging portion 11*b* of the positioning pin 11 is engaged with the small diameter portion 24*c*, so that the positioning pin 11 is engaged and fixed securely. Note that the sate of the movable locking member 24 being in the lock position is referred to as a lock state.

Furthermore, on this occasion, as shown in FIG. 3C, the plate spring 24*f* that can move together with each of the movable locking members 24 is contacted with the stopper portion 11*a* of each of the positioning pins 11 (i.e., a side face of the positioning pin 11). Therefore, the first frame 22 of the post processor 2 contacts each of the fixed locking members 23 screwed to the first frame 22 having an electrical connection with the same, each of the movable locking members 24 that contacts outer face of each of the fixed locking members 23, each of the plate springs 24*f* fixed to each of the movable locking members 24 having an electrical connection with the same, and each of the plate springs 24*f*. Further, it has an electric conduction with the second frame 103 of the copying machine 1 via each of the positioning pins 11 screwed to the second frame 103 having an electrical connection with the same.

Next, when the post processor 2 is detached from the copying machine 1, the user moves each of the movable locking members 24 to slide in the sliding direction from the lock position to the unlock position (in the direction indicated by an arrow E in FIG. 3C), the pin insertion hole 23*a* of each of the fixed locking members 23 and the large diameter portion 24*b* of each of the movable locking members 24 are overlapped with each other as shown in FIG. 3B and as described above. In addition, it becomes in the unlock state where each of the plate springs 24*f* is separated from the stopper portion 11*a* of each of the positioning pins 11. Then, the post processor 2 is moved in the direction indicated by an arrow F as shown in FIG. 3C so that the post processor 2 is detached from the copying machine 1.

On this occasion, each of the movable locking members 24 is in the unlock state, and each of the plate springs 24*f* is separated from the stopper portion 11*a* of each of the positioning pins 11. Therefore, each of the positioning pins 11 can be detached easily from the pin insertion hole 23*a* of each of the fixed locking members 23 and the large diameter portion 24*b* of each of the movable locking members 24 while the positioning pin 11 is not affected by the plate spring 24*f*. In other words, the post processor 2 can be detached easily from the copying machine 1. Therefore, if the post processor 2 happens to have a malfunction such as a paper jam, it is easy to detach the post processor 2 from the copying machine 1.

Figure 4:
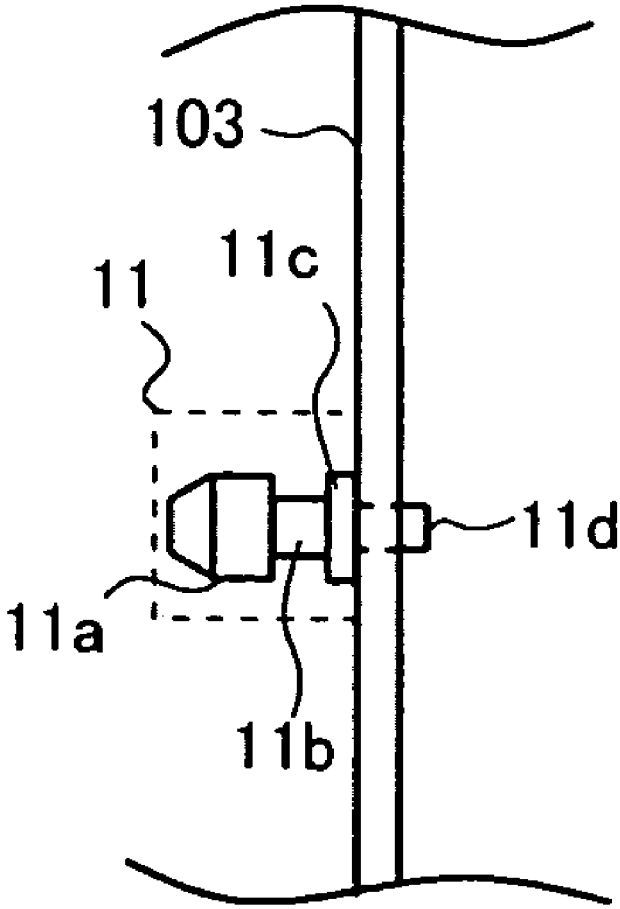
FIG. 4 is a side elevation showing schematically a positioning pin that is fixed to an exposed second frame.

In the above description, as shown in FIGS. 3A-3C, the positioning pin 11 of the copying machine 1 is screwed to the second frame 103 sandwiching the third frame 101 and the cover 102, so that an electrical conduction is formed between the positioning pin 11 and the second frame 103. However, it is possible to adopt another structure as shown in FIG. 4. In this structure, the positioning pin 11 of the copying machine 1 is screwed to the exposed second frame 103 without the third frame 101 and the cover 102, so that an electrical conduction is formed between the positioning pin 11 and the second frame 103.

As described above, if the connection device 21 according to this embodiment is used, the plate spring 24*f* does not abut the positioning pin 11 in the unlock position of the movable locking member 24. Therefore, it is easy to detach the post processor 2 having the connection device 21 from the copying machine 1, and the post processor 2 can be fixed to the copying machine 1 securely. In addition, when the movable locking member 24 is moved to slide to the lock position in the state where the positioning pin 11 is inserted in the pin insertion hole 23*a* of the fixed locking member 23 and the large diameter portion 24*b* of the movable locking member 24, the plate spring 24*f* that is not exposed to the outside of the post processor 2 contacts the positioning pin 11. Therefore, the first frame 22 of the post processor 2 can be connected electrically to the second frame 103 of the copying machine 1 by using the plate spring 24*f* securely without hurting the user.

Figure 5:
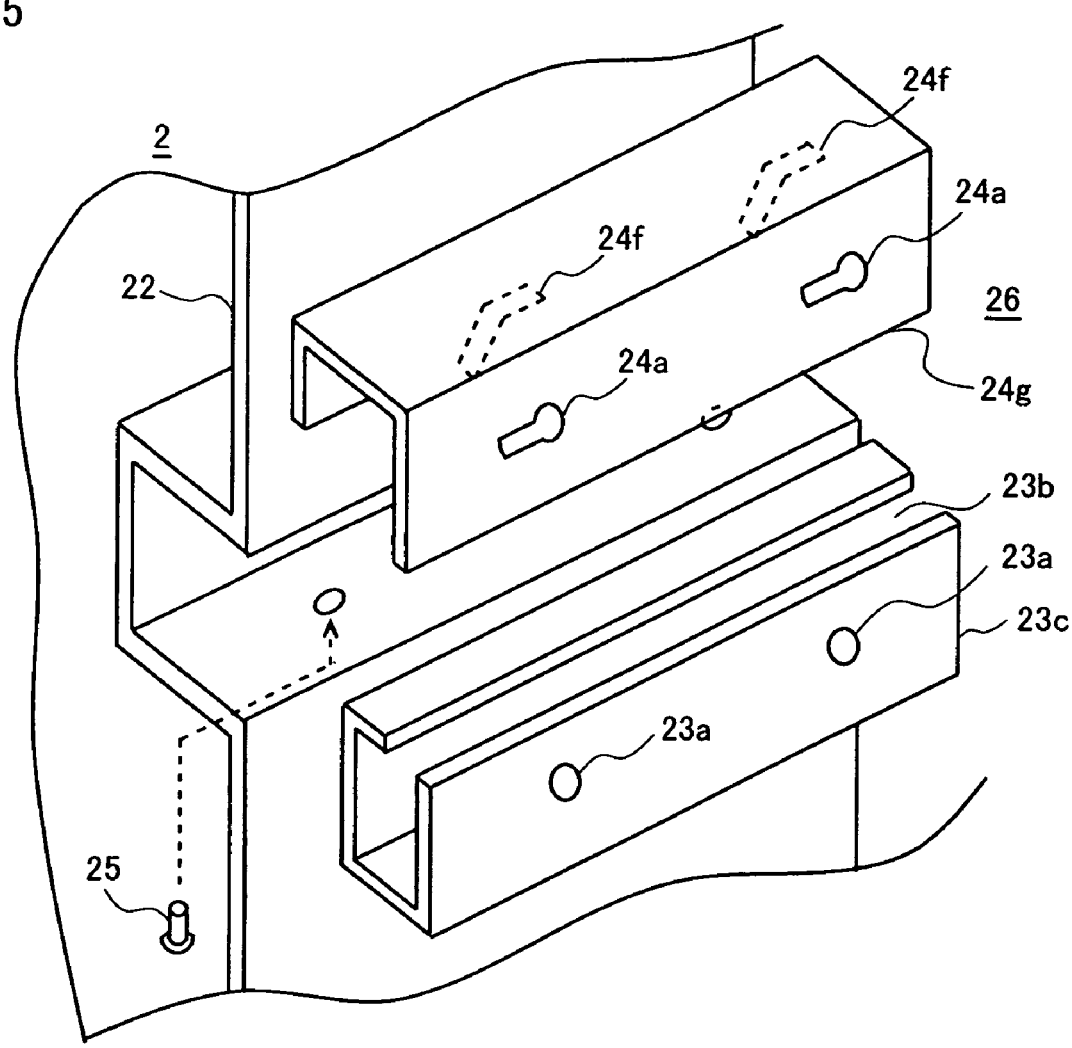
FIG. 5 is a perspective view showing schematically a connection device made up of two connection devices that are integrated.
Figure 6:
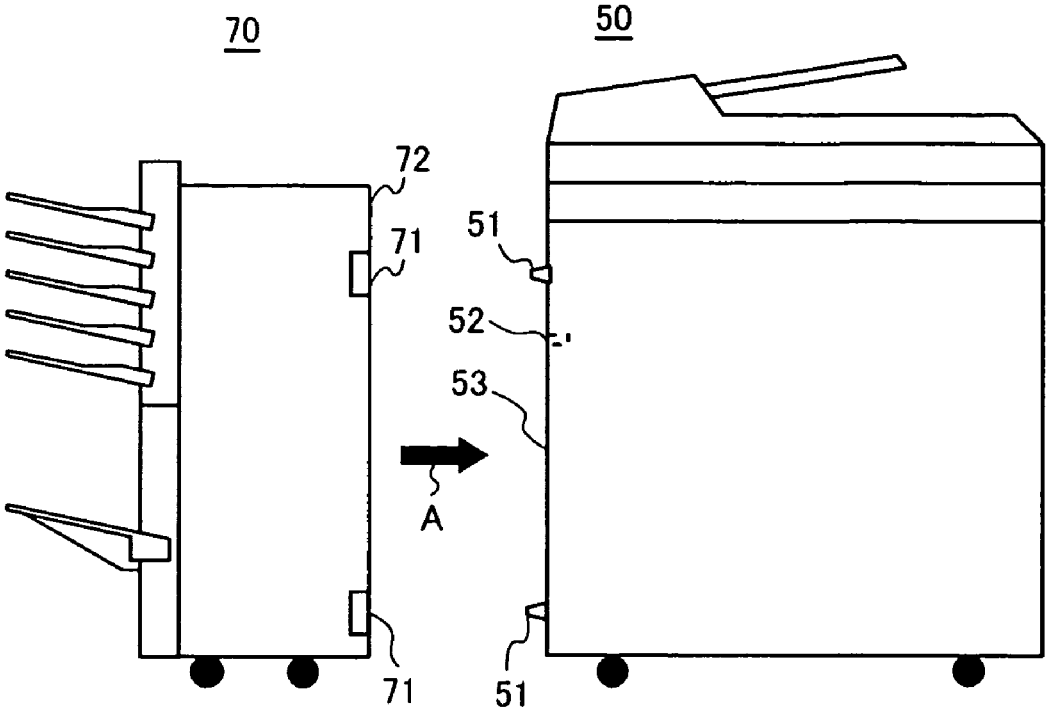
FIG. 6 is an elevation view showing schematically a post processor and a copying machine that are equipped with a conventional connection device.
Figure 7A:
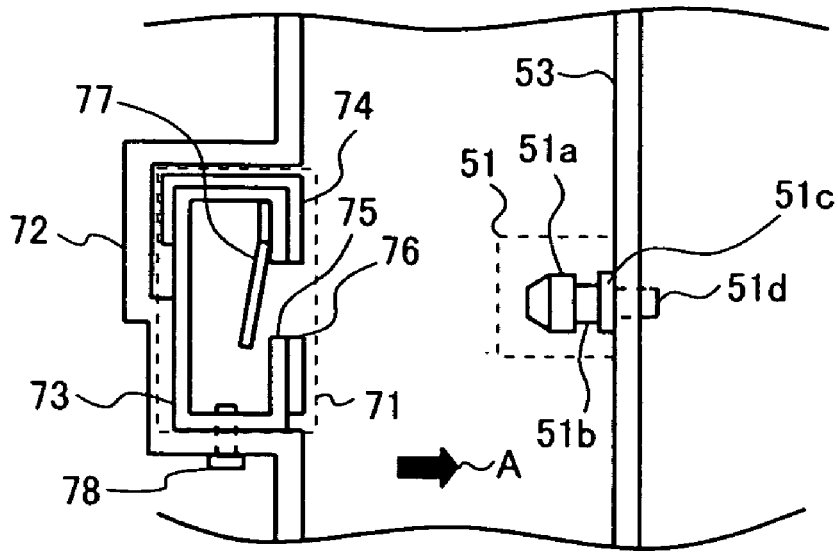
FIG. 7A is a longitudinal section showing the conventional connection device before the post processor is connected to the copying machine.
Figure 7B:
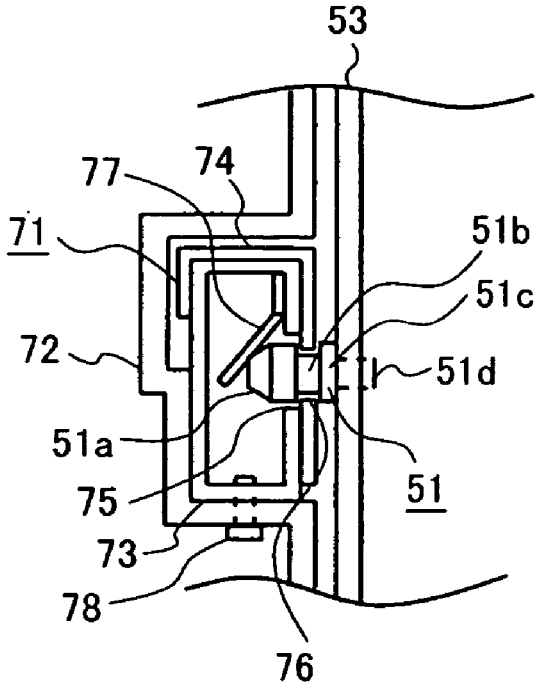
FIG. 7B is a longitudinal section showing the conventional connection device after the post processor is connected to the copying machine.
Figure 8A:
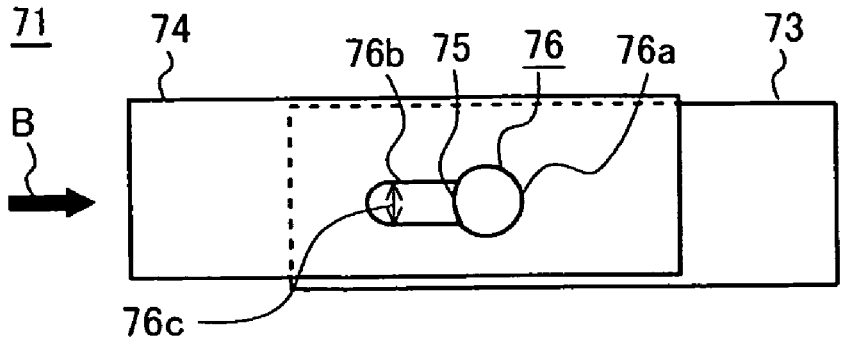
FIG. 8A is a schematic view from a side of the conventional connection device for explaining an unlock position.
Figure 8B:
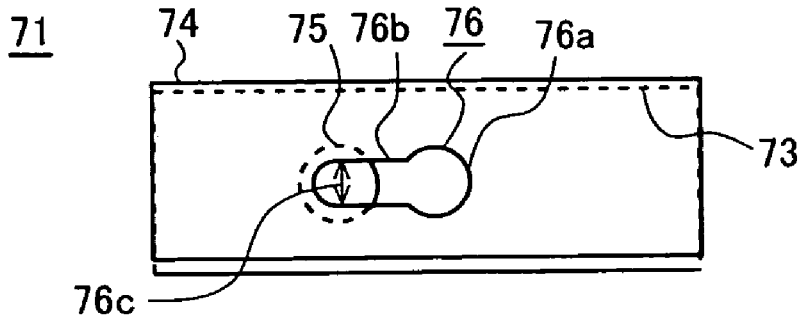
FIG. 8B is a schematic view from a side of the conventional connection device for explaining a lock position.

In addition, as shown in FIG. 5, if an integrated connection device 26 that includes a plurality of connection devices 21 is used (note that two connection devices 21 are integrated in FIG. 4), the plate spring 24*f* does not abut the positioning pin 11 in the same way as described above. Therefore, it is easy to attach and detach the post processor 2 with the connection device 21 to and from the copying machine 1, and the post processor 2 can be fixed to the copying machine 1 securely. In addition, the first frame 22 of the post processor 2 can be connected electrically to the second frame 103 of the copying machine 1 by suing the plate spring 24*f* securely without hurting the user. Note that the movable locking member 24*g* and the fixed locking member 23*c* shown in FIG. 5 correspond to the movable locking member 24 and the fixed locking member 23, respectively.

It is possible to modify the shape of the contact portion of the positioning pin 11 with the plate spring 24*f* so that a contact area is increased between the plate spring 24*f* and the positioning pin 11 for improving the electrical conduction. For example, the contact portion of the positioning pin 11 with the plate spring 24*f* may have a flat shape. In addition, the shape of the plate spring 24*f* may be changed so as to have a larger contact area with the positioning pin 11.

In addition, as described above, in the lock state of the positioning pin 11 with the movable locking member 24, the plate spring 24*f* abuts a side face of the stopper portion 11*a* of the positioning pin 11 as shown in FIG. 3C. However, it is not necessary to limit to the structure in which the plate spring 24*f* abuts a side face of the stopper portion 11*a* of the positioning pin 11 in the lock state of the positioning pin 11 with the movable locking member 24. It is possible to modify the position of the plate spring 24*f*, the position of the second elliptic hole 23*b* of the fixed locking member 23 or the like, so that the plate spring 24*f* abuts the upper face or the like of the stopper portion 11*a* of the positioning pin 11.

In addition, as described above, the connection device 21 according to the present invention is provided to the post processor 2. It is possible to provide the connection device 21 not to the post processor 2 but to the copying machine 1 for obtaining the same effect. In this case, it is preferable that the conductive first frame 22 of the post processor 2 is provided with the positioning pin 11 that is connected to the first frame 22 electrically.

In addition, as described above, four connection devices 21 are provided to the first frame 22. However, the number thereof is not limited to four. Furthermore, the connection device 21 may be divided so as to be disposed on the conductive frame that is arranged to cover a predetermined area.

In addition, the connection device 21 according to the present invention described above can be used for making a mechanical connection and an electrical conduction between devices having a conductive frame or the like.

In addition, the structure according to the present invention is not limited to the above embodiment but can be modified variously in the scope of the present invention without deviating from the spirit thereof.

What is claimed is:

1. A connection device comprising:

a fixed locking member that is a conductive member connected electrically to a conductive first frame of a first device, an end of the fixed locking member being connected electrically to a conductive second frame of a second device and the other end of the fixed locking member being provided with a pin insertion hole for inserting a conductive columnar pin having an engaging portion;

a movable locking member that is a conductive member contacting an outer face of the fixed locking member and can slide in a sliding direction that is perpendicular to an insertion direction of the pin, the movable locking member having a first elliptic hole including a large diameter portion at an end for inserting the pin and a small diameter portion extending in the sliding direction for retaining an engaging portion of the pin, wherein the movable locking member includes a conductive member having an end that is connected electrically to a face that is opposed to the fixed locking member, the fixed locking member includes a second elliptic hole extending in the sliding direction for the conductive member to be inserted and move together with the movable locking member, the pin insertion hole and the large diameter portion of the first elliptic hole are overlapped with each other so as to permit insertion of the pin when the movable locking member is moved to slide to an unlock position, and the pin engages the small diameter portion of the first elliptic hole to engage and fix the pin so that the first device and the second device are connected and the conductive member contacts the pin when the movable locking member is moved to slide from the unlock position to a lock position while the pin is inserted.

2. An image forming apparatus equipped with a connection device according to claim 1.

3. An optional device equipped with a connection device according to claim 1.

* * * * *